US007194213B2

(12) United States Patent
Taguchi

(10) Patent No.: US 7,194,213 B2
(45) Date of Patent: Mar. 20, 2007

(54) IMAGE FORMING APPARATUS AND IMAGE FORMING METHOD

(75) Inventor: Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/410,739

(22) Filed: Apr. 25, 2006

(65) Prior Publication Data

US 2006/0188271 A1 Aug. 24, 2006

Related U.S. Application Data

(63) Continuation of application No. 10/728,102, filed on Dec. 3, 2003, now Pat. No. 7,065,304.

(51) Int. Cl.
*G03G 15/01* (2006.01)
*G03G 15/08* (2006.01)

(52) U.S. Cl. ..... 399/12; 399/27; 399/53; 399/227

(58) Field of Classification Search ..... 399/227, 399/226, 233, 119, 120, 12, 27, 28, 53, 262, 399/223
See application file for complete search history.

(56) References Cited

U.S. PATENT DOCUMENTS 5,095,331 A 3/1992 Takano ..... 399/27 X
6,009,293 A 12/1999 Takami ..... 399/227
6,295,429 B1 * 9/2001 Isobe et al. ..... 399/227
6,301,460 B1 10/2001 Elliott ..... 399/227 X
6,327,449 B1 * 12/2001 Matsuzaki ..... 399/227
2003/0012576 A1 1/2003 Owen et al. ..... 399/27
2003/0133719 A1 7/2003 Tsuruya et al. ..... 399/12

FOREIGN PATENT DOCUMENTS

JP 61-151576 7/1986
JP 09-190145 7/1997
JP 10-031395 2/1998
JP 10-301358 11/1998
JP 2003-043773 A * 2/2003
JP 2003-316106 11/2003

* cited by examiner

*Primary Examiner*—Sophia S. Chen
(74) *Attorney, Agent, or Firm*—Hogan & Hartson LLP

(57) ABSTRACT

An image forming apparatus includes an electrostatic latent image carrier. A plurality of development units each accommodate a toner and are held by a development unit holder. A control unit controls the development unit holder and selectively changes over the development unit used in development. An identifying device identifies color information on the toner. The development unit holder holds at least two development units accommodating toner of a same color. The control unit identifies development units of the same color based on the color information identified by the identifying device, and controls the development unit holder to effect monochrome development by using the at least two development units.

16 Claims, 5 Drawing Sheets ok

IMAGE FORMING APPARATUS AND IMAGE FORMING METHOD

This is a continuation of application Ser. No. 10/728,102 filed Dec. 3, 2003, now U.S. Pat. No. 7,065,304, the entire contents of which are incorporated by reference. This application is also based on Japanese Patent Application No. 2001-157124 filed May 25, 2001, and its subject matter is incorporated herein by reference.

BACKGROUND OF THE INVENTION

1. Field of the Invention

The present invention relates to an image forming apparatus, such as a color printer and a facsimile machine, and an image forming method for forming an image by using electrophotographic technology.

2. Description of the Related Art

Generally, an image forming apparatus (color printer) using electrophotographic technology is comprised of a photosensitive body, a charging means for charging the outer peripheral surface of the photosensitive body, an exposure unit for forming an electrostatic latent image by selectively exposing the outer peripheral surface of the photosensitive body, and a development unit for developing the electrostatic latent image into a toner image. Further, the image forming apparatus has a transfer unit for transferring the toner image onto a transfer object. A development rotary serving as a development unit holder, which has a substantially hollow cylindrical shape and is rotatably supported, is disposed at a position adjacent to the photosensitive body. The development rotary is formed in such a manner as to be capable of detachably installing development units of four colors (yellow Y, magenta M, cyan C, and black K).

However, with the image forming apparatus of the above-described conventional configuration, since four development units are installed to form a color image, the size of each development unit becomes smaller than the size of one development unit in an image forming apparatus for a monochromatic color. For this reason, if development, i.e., printing, is effected in monochrome in a large quantity by using the toner of one development unit in the image forming apparatus for forming a color image, a time when the toner is used up becomes early as compared with a case where an image forming apparatus for a monochromatic color is used.

Furthermore, the amounts of toners accommodated in the four development units are substantially the same. For this reason, in the case where monochromatic color printing is effected by using the toner of one development unit, a time when the toner used is used up becomes early as compared with the other toners. Accordingly, it is necessary to replace time and again the development unit of the toner used for the monochromatic color printing and replenish the toner, so that there has been a problem in that the replacement operation is very troublesome.

In addition, it was conceived to form the development unit used in monochromatic color printing to be larger than the development units of the other colors, so as to increase the amount of toner accommodated. In that case, however, there is a limit to the size in making the development unit large owing to such as the internal-structure of the color printer and the position where the development unit is installed. Additionally, a design change must be made in the shape of the development rotary to allow development units of different sizes, i.e., shapes, to be mounted, so that there has been a problem in that the manufacturing cost becomes high.

SUMMARY OF THE INVENTION

The present invention has been devised by focusing attention on the problems inherent to such conventional art. Its object is to provide an image forming apparatus and an image forming method which make it possible to effect development by a monochromatic toner in a large quantity without changing the design of the development units and the development unit holder and which, during the development, make it possible to reduce the number of times of replacement of the development unit by delaying the time when the toner is used up.

(1) To attain the above object, the image forming apparatus of the invention is an image forming apparatus including an electrostatic latent image carrier for carrying an electrostatic latent image on a peripheral surface thereof, a plurality of development units each accommodating a toner and adapted to develop the electrostatic latent image by the toner, a development unit holder capable of holding the plurality of development units, and a control unit for the development unit holder for controlling the operation of the development unit holder and for selectively changing over the development unit used in development among the plurality of development units, the image forming apparatus characterized by comprising: an identifying device for identifying at least color information on the toner accommodated in the development unit, wherein the development unit holder is capable of holding at least two development units accommodating the toner of a same color, and wherein the control unit identifies the development units of the same color based on the color information identified by the identifying device, and controls the operation of the development unit holder so as to effect monochrome development by using the at least two development units.

(2) The image forming apparatus of the invention is characterized in that the development unit has storage means for storing the color information, and the color information is identified by the identifying device.

(3) The image forming apparatus of the invention is characterized in that the development unit holder is a rotary body which selectively changes over the development unit used in development as the rotary body is rotatively driven, and the rotary body moves any one of the plurality of development units to a position opposing the electrostatic latent image carrier as the development unit holder is rotatively driven by the control unit.

(4) The image forming apparatus of the invention is characterized in that the operation of the development unit holder is controlled at a predetermined timing by the control unit, and during development by a monochromatic toner a changeover is made to another development unit accommodating the toner of the same color as the toner used in the development (5) The image forming apparatus of the invention is characterized in that when development by the monochromatic toner continues, the predetermined timing is set to a time when a predetermined number of pages has reached a predetermined value.

(6) The image forming apparatus of the invention is characterized in that the development unit has storage means for storing an amount of toner consumed, and the predetermined timing is set to a time when an amount of toner consumed has reached a predetermined value.

(7) The image forming method of the invention is a method of forming an image by an image forming apparatus in which color information on a toner accommodated in a plurality of development units held in a development unit holder is identified by an identifying device, and the development unit used in development is selectively changed over among the plurality of development units by a control unit for controlling the development unit holder, so as to effect development, comprising the steps of: identifying the color information on the toner accommodated in the development unit by the identifying device; and identifying the development units of a same color based on the color information, and controlling the operation of the development unit holder by the control unit so as to effect monochrome development by using at least two of the development units accommodating the toner of the same color.

DESCRIPTION OF THE PREFERRED EMBODIMENTS (First Embodiment)

Figure 1:
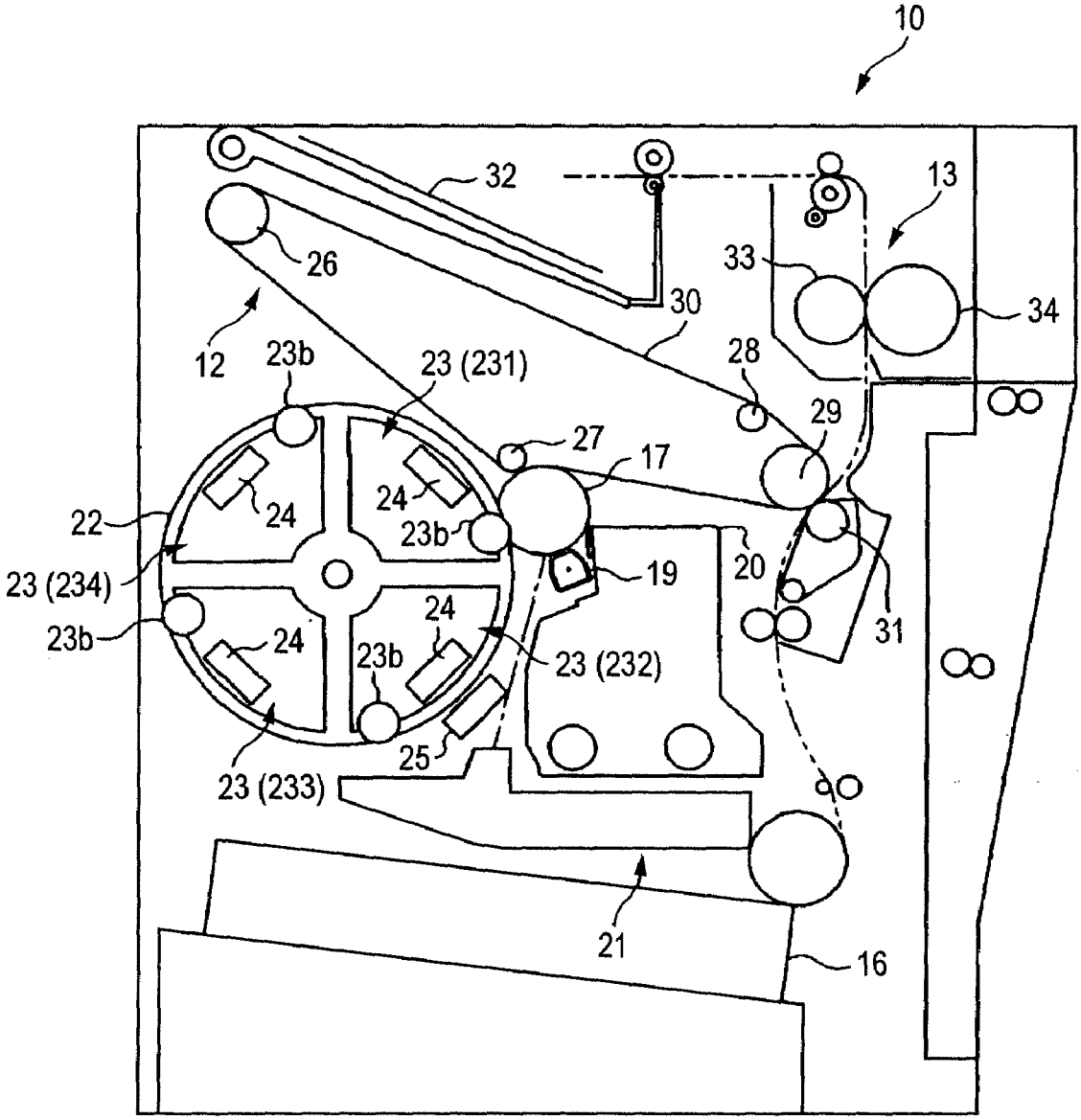
FIG. 1 is a schematic diagram illustrating an image forming apparatus in accordance with an embodiment.

Referring now to the drawings, a description will be given of a first embodiment in which the present invention is embodied as an image forming apparatus (color printer). FIG. 1 is a diagram schematically illustrating the interior of an image forming apparatus 10. It should be noted that in this first embodiment a description will be given of the embodiment of printing with a monochromatic toner, i.e., monochrome printing, in which a black toner accommodated in four development units 23 (231 to 234) is used.

First, a description will be given of an outline of the interior of the image forming apparatus 10. As shown in FIG. 1, the following are provided in the image forming apparatus 10: a photosensitive body 17 serving as an electrostatic latent image carrier for carrying an electrostatic latent image on its peripheral surface; the development units 23 for accommodating a toner and developing the electrostatic latent image by the toner; and a development rotary 22 serving as a development unit holder capable of holding the plurality of development units 23. In addition, further provided are an exposure unit 21, an intermediate transfer unit 12, a fixing unit 13, a paper feeder 16, and a control unit 14 for providing control of the entire image forming apparatus 10 shown in FIG. 3.

As shown in FIG. 1, the photosensitive body 17 has the shape of a drum, and a charger 19 for coming into sliding contact with an outer peripheral surface of the photosensitive body 17 and uniformly charging the outer peripheral surface is installed at a position adjacent to the photosensitive body 17. After the outer peripheral surface of the photosensitive body 17 has been charged by the charger 19, selective exposure corresponding to desired image information is effected on a photosensitive layer (not shown) of the photosensitive body 17 by the exposure unit 21, and an electrostatic latent image corresponding to the image information is formed on the photosensitive layer.

The development rotary 22 is disposed at a position adjacent to the photosensitive body 17 in such a manner as to be capable of being rotatively driven, and is constructed so as to be capable of holding the four development units 23 (hereafter referred to as first, second, third, and fourth development units 231, 232, 233, and 234 in this specification). In addition, position identifying devices (not shown) capable of respectively identifying the positions of the development units 23 held are provided in the development rotary 22, and the position identifying devices are arranged to be capable of outputting position information to the control unit 14.

Figure 2:
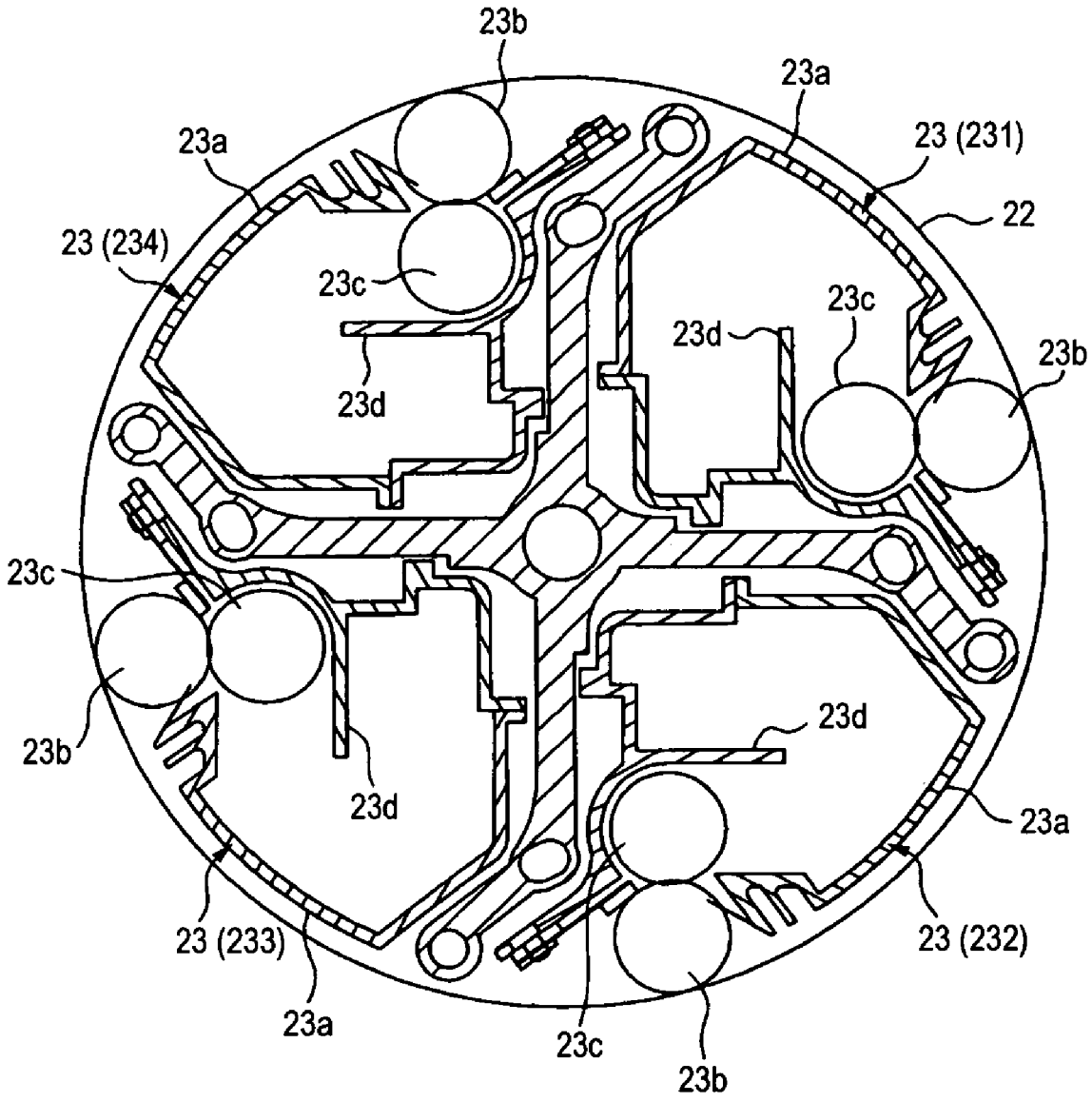
FIG. 2 is a cross-sectional view illustrating a development rotary and development units in accordance with the embodiment.

As shown in FIG. 2, the development units 231 to 234 are respectively formed in an identical shape, and have cases 23*a* capable of accommodating the toner therein. Further, each case 23*a* is provided with a development roller 23*b* supported rotatably by the case 23*a*, as well as a supply roller 23*c* supported rotatably in the case 23*a* and adapted to supply the toner to the surface of the development roller 23*b* by coming into pressure contact with the development roller 23*b*. Furthermore, a partition plate 23*d* is provided in the case 23*a*, and the interior of the case 23*a* is partitioned into the supply roller 23*c* side and the innermost side inside the case 23*a* by that partition plate 23*d*. A black toner is accommodated in each of the development units 231 to 234.

Figure 3:
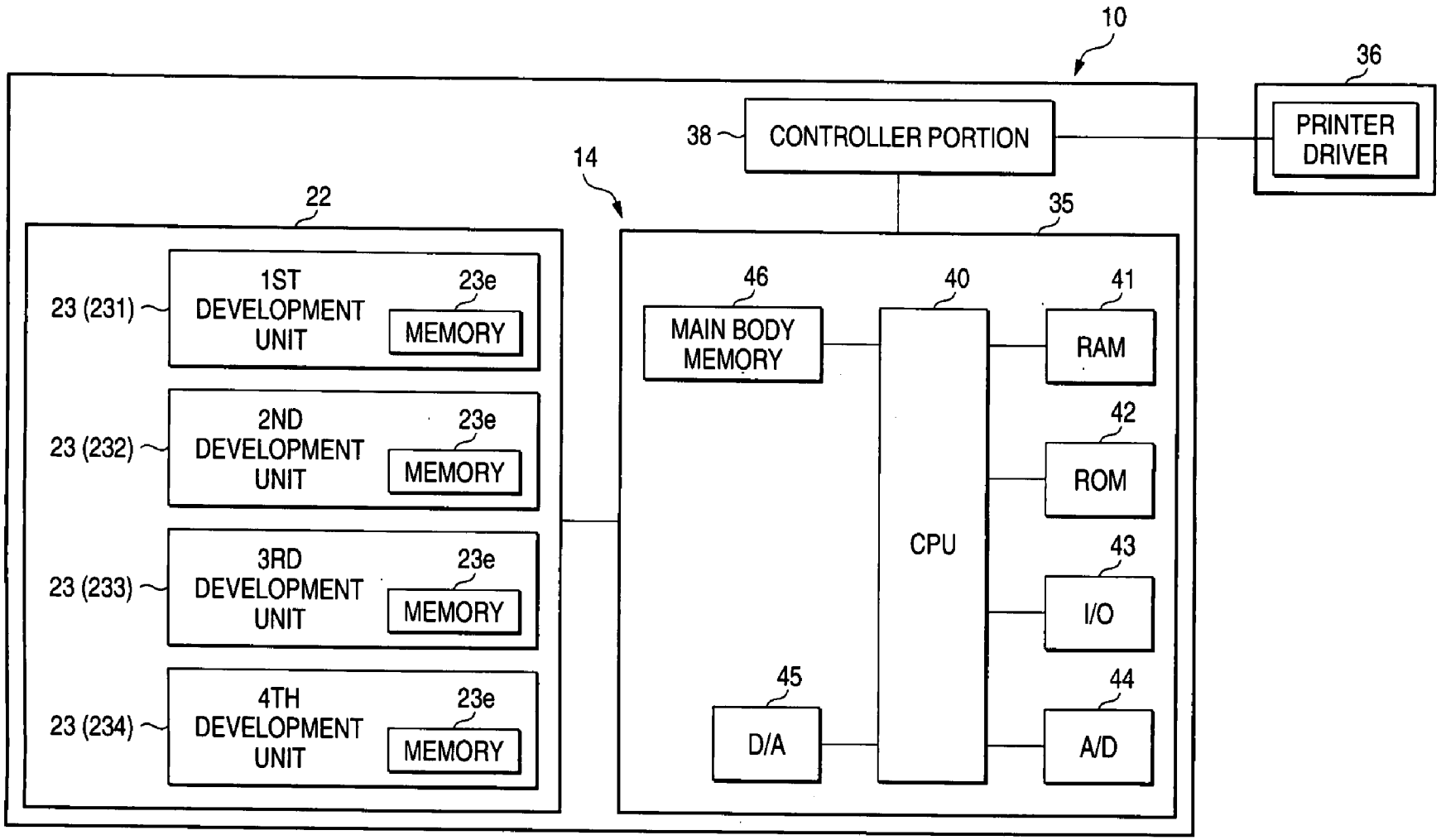
FIG. 3 is a block diagram illustrating a control unit in accordance with the embodiment.

In addition, as shown in FIG. 3, each of the development units 231 to 234 is provided with a nonvolatile memory 23*e* (shown as a memory in FIG. 3) constituted by a ROM as a color-information storing means and a storage means for storing the amount of toner consumed. Identification information for allowing each development unit 231 to 234 to be individually identified, such as toner color information, consumption amount information, and the date of manufacture of the toner accommodated in the case 23*a*, is stored in each nonvolatile memory 23*e*.

In addition, as shown in FIG. 1, the development units 231 to 234 are respectively provided with development side connectors 24, and the nonvolatile memories 23*e* are respectively connected to the development side connectors 24. Meanwhile, a control side connector 25, which is connectable to the development side connector 24 and is arranged so as to be movable between its connecting position and its nonconnecting position, is provided at a position in the vicinity of the development rotary 22.

In the state in which the four development units 231 to 234 are held or, specifically speaking, installed, the development rotary 22 is rotatively driven by the control unit 14 so that the development side connector 24 of any one of the development units 231 to 234 assumes a connectable position with respect to the control side connector 25. Then, the two connectors 24 and 25 are connected to read the identification information including the color information of the nonvolatile memory 23*e*, and the identification information on the four development units 231 to 234 is stored in the control unit 14. Further, the color information of the development units 231 to 234 in the development rotary 22 and the position information identified by the position-identifying devices are related to each other, and the positions in the development rotary 22 where the development units 231 to 234 of the respective colors are installed are stored in the control unit 14.

In addition, in the installed state, as the rotation of the development rotary 22 is controlled by the control unit 14, the development roller 23*b* of one of the development units 231 to 234 is disposed at a position (development position)

where it opposes the photosensitive body 17. At this development position, the toner worn and charged by the rotation of the supply roller 23*c* is supplied to the development roller 23*b* side, and the toner as carried on the surface of the development roller 23*b* is transferred onto a photosensitive layer of the photosensitive body 17. Then, an electrostatic latent image on the photosensitive body 17 is developed (toner image) by the toner and is formed into a visible image.

Further, the charged toner, which is on the supply roller 23*c* side in the case 23*a* of each development unit 231 to 234 and has been collected after being used at the time of development, is discharged from the supply roller 23*c* side to the innermost side inside the case 23*a* as the rotation of the development rotary 22 is controlled. Subsequently, as the rotation of the development rotary 22 is controlled, the charged toner is mixed and agitated with the unused toner, and the two toners are uniformly dispersed and refreshed. Then, when the relevant one of the development units 231 to 234 is positioned again at the development position, the refreshed toner is supplied to the supply roller 23*c* side.

As shown in FIG. 1, the intermediate transfer unit 12 disposed at a position above the photosensitive body 17 consists of a drive roller 29, a primary transfer support roller 27, a tension roller 28, a cleaner backup roller 26, an endless intermediate transfer belt 30 trained between the rollers 29 to 29, and a cleaning means (not shown). The photosensitive body 17 is disposed at a position opposing the primary transfer support roller 27 with the intermediate transfer belt 30 interposed therebetween, and a secondary transfer roller 31 is disposed at a position opposing the drive roller 29 with the intermediate transfer belt 30 nipped therebetween.

As a gear (not shown) fixed to an end portion of the drive roller 29 meshes with a drive gear (not shown) of a drive motor of the photosensitive body 17, the drive roller 29 is arranged to be rotatively drivable at substantially the same peripheral speed as the photosensitive body 17. Namely, the intermediate transfer belt 30 is circulatingly driven at substantially the same peripheral speed as the photosensitive body 17.

Then, in the process in which the intermediate transfer belt 30 is circulatingly driven, the toner image formed on the photosensitive body 17 is transferred onto the intermediate transfer belt 30 at a pressure contact portion between the primary transfer support roller 27 and the photosensitive body 17. Further, the toner image transferred onto the intermediate transfer belt 30 is transferred onto a recording medium 32 such as paper fed from the paper feeder 16 at a pressure contact portion between the secondary transfer roller 31 and the drive roller 29. The fixing unit 13 disposed at a position adjacent to the intermediate transfer unit 12 consists of a fixing roller 33 having a heat source and a pressure roller 34 which is held in pressure contact with this fixing roller 33.

Finally, after the toner image transferred onto the recording medium 32 is fixed on the recording medium 32 by the fixing unit 13, the recording medium 32 is discharged from outside the color printer. It should be noted that the toner remaining on the photosensitive body 17 is removed by a cleaning device 20 disposed at a position adjacent to the photosensitive body 17.

Next, a description will be given of the control unit 14 for controlling the above-described image forming apparatus 10. As shown in FIG. 3, the control unit 14 consists of a controller portion 38 and an engine control portion 35, and the two portions are connected to each other through an interface line. The controller portion 38 effects communication with a host computer 36, and the arrangement provided is such that various information such as image information prepared by application software or the like of a personal computer (not shown) is sent from the host computer 36 to the controller portion 38. The controller portion 38 has the function of converting RGB data of red, green, and blue serving as image information signals sent from the host computer 36, into image data of yellow, magenta, cyan, and black. Further, the controller portion 38 has the function of storing the image data in a memory (not shown) of the controller portion 38. It should be noted that, in this embodiment, the RGB data is converted into image data of black to effect monochrome printing.

The engine control portion 35 has a CPU 40 serving as an identifying device and a control device, as well as a RAM 41, a ROM 42, an I/O control portion 43, an A/D converter 44, a D/A converter 45, a main body memory 46, and the like. The CPU 40 controls various portions making up the image forming apparatus 10, and identifies the color information and the consumption amount information of the toner in the development units 231 to 234. Then, when the CPU 40 determines that the amount of toner consumed has reached a predetermined amount, the CPU 40 controls the rotative driving of the development rotary 22 at a predetermined timing. Further, when the CPU 40 determines that the amount of toner consumed in terms of an amount required for printing on the recording medium 32 of a predetermined size has reached a portion of a predetermined number of pages, the CPU 40 controls the rotative driving of the development rotary 22.

In addition, the CPU 40 is so arranged that when the development side connector 24 of any one of the development units 231 to 234 and the control side connector 25 are connected, the CPU 40 becomes capable of communicating with the nonvolatile memory 23*e*, and becomes capable of reading the identification information of the nonvolatile memory 23*e* or capable of reading new identification information in the nonvolatile memory 23*e*. Further, the CPU 40 is so arranged as to identify the positions where the development units 231 to 234 of the respective colors are installed, by relating the identification information to the position information on the respective development units 231 to 234 in the development rotary 22.

Then, the CPU 40 identifies the positions and colors of the development units 231 to 234 of the development rotary 22, and provides control for rotating the development rotary 22 to cause one of the development units 231 to 234 accommodating the toner of a specified color to be located at the development position. In particular, during development of a monochromatic toner, the CPU 40 provides control for effecting a changeover to another development unit 23 accommodating the toner of the same color as that of the toner used in that development at a predetermined timing.

The RAM 41 temporarily stores various information on the image forming apparatus 10. In addition, the ROM 42 stores various programs for controlling the image forming apparatus 10, and the I/O control portion 43 controls input/output data. The A/D converter 44 converts an analog signal in the image forming apparatus 10 into a digital signal, whereas the D/A converter 45 converts a digital signal into an analog signal. The main body memory 46 stores information on the presence or absence of the development units 231 to 234 in the development rotary 22, toner color information written in the nonvolatile memory 23*e*, various identification information such as the toner consumption amount information, and position information. Additionally, by means of the identification information and the position information the main body memory 46 stores the positions in the development rotary 22 where the development units 231 to 234 accommodating the respective colors are installed.

Figure 4:
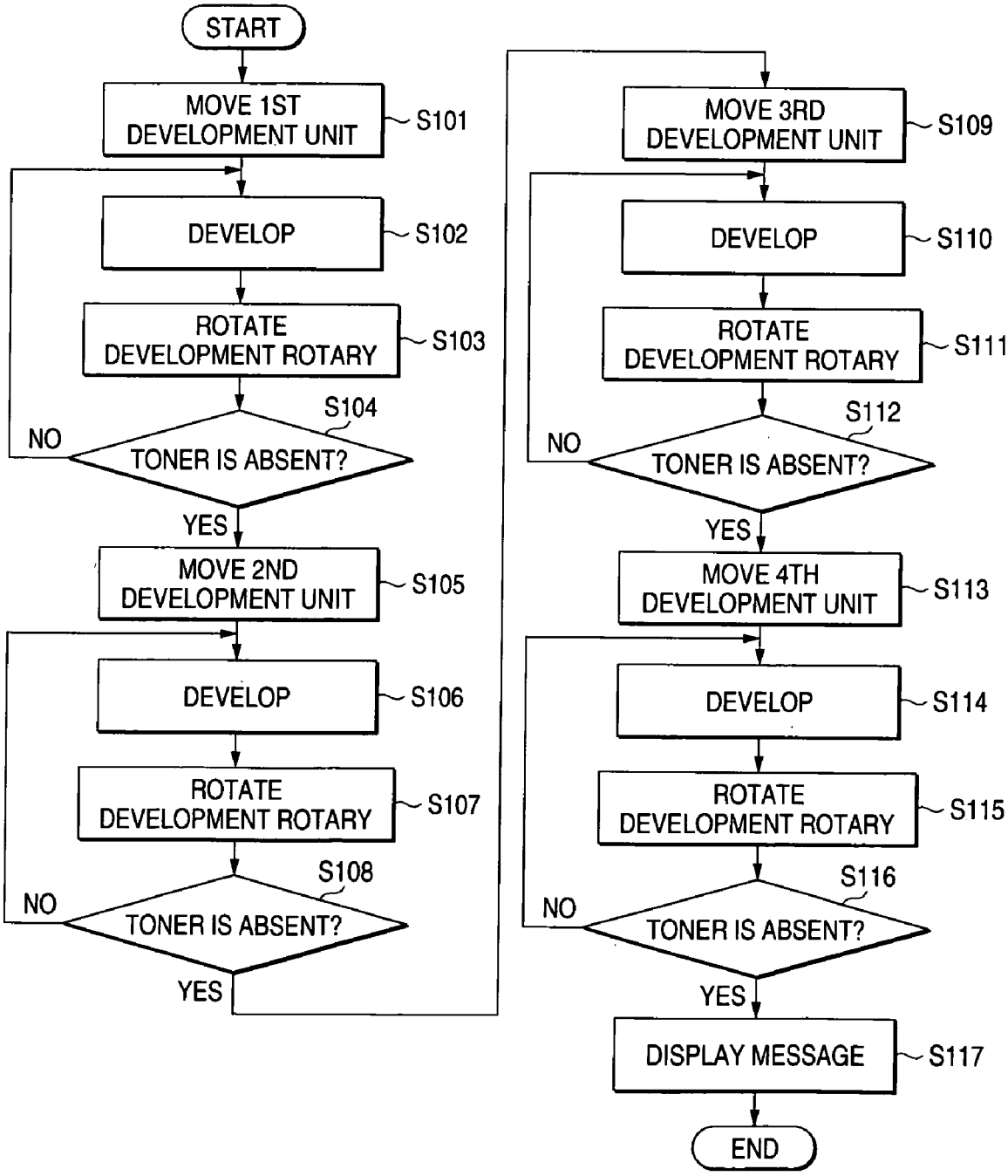
FIG. 4 is a flowchart illustrating a development operation in accordance with a first embodiment.

Referring next to the flowchart shown in FIG. 4, a description will be given of the operation of effecting development by using the four development units 231 to 234 (which will be referred to as the first development unit 231, the second development unit 232, the third development unit 233, and the fourth development unit 234) for effecting monochrome printing by the image forming apparatus 10 of the above-described configuration. It should be noted that this operation is executed under control by the CPU 40 based on a program stored in the ROM 42. In addition, identification information to the effect that the black toner is accommodated in the respective nonvolatile memories 23*e* of the development units 231 to 234.

Prior to the development operation, the development units 231 to 234 and the CPU 40 communicate, and information on the presence or absence of the four development units 231 to 234 and identification information on the development units 231 to 234 are stored in the main body memory 46. Additionally, the positions where the development units 231 to 234 are installed are also stored in the main body memory 46.

After a print command signal (image information signal) from the host computer 36 is converted into black image data by the controller portion 38, the black image data is stored in the memory of the controller portion 38. Upon completion of the conversion of the image data of a predetermined amount, information requesting a development start is transmitted to the engine control portion 35. Then, an electrostatic latent image is formed by the charger 19 and the exposure unit 21.

Subsequently, the development rotary 22 is rotatively driven to move the first development unit 231 to the development position (Step 101 (hereafter simply referred to as S101)). Next, the development of the electrostatic latent image is effected by using the toner in the first development unit 231 (S102) Subsequently, it is determined that the amount of toner consumed in the first development unit 231 has reached such an amount at which the toner can be accommodated on the supply roller 23*c* side from the partition plate 23*d* of the case 23*a*. Then, the development rotary 22 is rotatively driven 360 degrees under control (S103), so that the agitation of the toner in the first development unit 231 is effected, and the toner which is present on the innermost side inside the case 23*a* is supplied to the supply roller 23*c* side.

Then, the amount of toner consumed in the first development unit 231 is read after the rotation of the development rotary 22, and the presence or absence of the toner is determined (S104). If it is determined that the amount of toner consumed has not reached the amount of toner which was accommodated in the first development unit 231, and that the toner is still present in the first development unit 231 (NO in S104), development is continued by using the toner in the first development unit 231.

If it is determined that the amount of toner consumed has reached the amount of toner which was accommodated in the first development unit 231, and that the toner is practically absent in the first development unit 231 (YES in S104), the development rotary 22 is rotatively driven 90 degrees, and the second development unit 232 is moved to the development position (S105), effecting a changeover to the different second development unit 232 accommodating the black toner. Next, development of the electrostatic latent image is effected by using the toner of the second development unit 232 (S106).

Then, in the same way as in the case of the first development unit 231, as the development rotary 22 is rotatively driven 360 degrees, the agitation and supply of the toner in the second development unit 232 are subsequently carried out (S107). After the rotation of the development rotary 22, the presence or absence of the toner is determined (S108). If it is determined that the toner is present in the second development unit 232 (NO in S108), development is continued by using the toner in the second development unit 232. On the other hand, if it is determined that the toner is absent in the second development unit 232 (YES in S108), the development rotary 22 is rotatively driven 90 degrees, and the third development unit 233 is moved to the development position (S109). Then, development is effected by using the toner of the third development unit 233 (S110).

Subsequently, as the development rotary 22 is rotatively driven 360 degrees, the agitation and supply of the toner in the third development unit 233 are carried out (S111). After the rotation of the development rotary 22, the presence or absence of the toner is determined (S112). If it is determined that the toner is present in the third development unit 233 (NO in S112), development is continued by using the toner in the third development unit 233. On the other hand, if it is determined that the toner is absent in the third development unit 233 (YES in S112), the development rotary 22 is rotatively driven 90 degrees, and the fourth development unit 234 is moved to the development position (S113).

Further, development is effected by using the toner of the fourth development unit 234 (S114). Then, as the development rotary 22 is rotatively driven 360 degrees, the agitation and supply of the toner in the fourth development unit 234 are carried out (S115). After the rotation of the development rotary 22, the presence or absence of the toner is determined (S116) If it is determined that the toner is present in the fourth development unit 234 (NO in S116), development is continued by using the toner in the fourth development unit 234. On the other hand, if it is determined that the toner is absent in the fourth development unit 234 (YES in S116), a message to the effect that the toner is absent is displayed on a display portion (not shown) of the image forming apparatus 10 (S117), and development in a monochromatic color, i.e., print processing, ends.

A description will be given hereafter of advantages offered by the above-described first embodiment.

(1) The CPU 40 recognizes that the development units 231 to S234 accommodating the black toner are installed at all the positions on the development rotary 22. For this reason, the CPU 40 recognizes that the black toner in one development unit 23 has been used up, the CPU 40 identifies the position of the development unit 23 accommodating the toner of the same color, and moves the development unit 23 located at an adjacent position to the development position. For this reason, as soon as the toner has been used up, monochrome development can be effected by consecutively using the toner of the adjacent development units 231 to 234. Accordingly, unlike the conventional method in which monochrome printing is effected by using the black toner accommodated in only one of the four development units 231 to 234, it is possible to delay the time when the toner is used up by securing a large amount of toner. Thus, it is possible to reduce the number of operations of replacing the development units 231 to 234 accompanying the toner replenishment, and effect monochrome development, i.e., monochrome printing, in a large quantity.

(2) Since the development units 231 to 234 of the same shape are used, it becomes unnecessary to make design changes of the development units 231 to 234 for securing a large amount of toner accommodated, and make a design change in the development rotary 22 for allowing the development units 231 to 234 to be installed. Accordingly, it becomes possible to effect monochrome development, i.e., monochrome printing, in a large quantity without making a design change in the conventional image forming apparatus 10, so that it is possible to eliminate the drawback that the manufacturing cost becomes high as a consequence of the design change.

(3) As soon as the toner is used up, development is effected by using the adjacent development units 231 to 234 in the order of the first development unit 231, the second development unit 232, the third development unit 233, and the fourth development unit 234. For that reason, as compared with a case where development is effected by using development units which are at opposing positions, e.g., the first development unit 231 and the third development unit 233, it is possible to shorten the time required for the rotative driving of the development rotary 22, and improve development throughput, i.e., printing throughput, in a predetermined period of time.

(4) In the course of development by the development units 321 to 234, the development rotary 22 is rotated to supply the toner accommodated on the innermost side inside the case 23*a* from the partition plate 23*d* to the supply roller 23*c* side from the partition plate 23*d*. For this reason, it is possible to overcome the trouble that although the amount of toner consumed has not reached a predetermined amount, the toner is used up on the supply roller 23*c* side, making development impossible.

(Second Embodiment)

Hereafter, in a second embodiment, a description will be given mainly of aspects which differ from the above-described first aspect, and a description will be given by denoting identical members to those of the first embodiment by identical reference numerals. In the second embodiment, a program for controlling the rotative driving of the development rotary 22 by the CPU 40 at a timing based on a predetermined criterion is stored in the ROM 42. The aforementioned timing is set to whether or not the amount of toner used has reached a continuous 10-page portion in terms of an amount necessary for printing on an A4-size recording medium 32.

Figure 5:
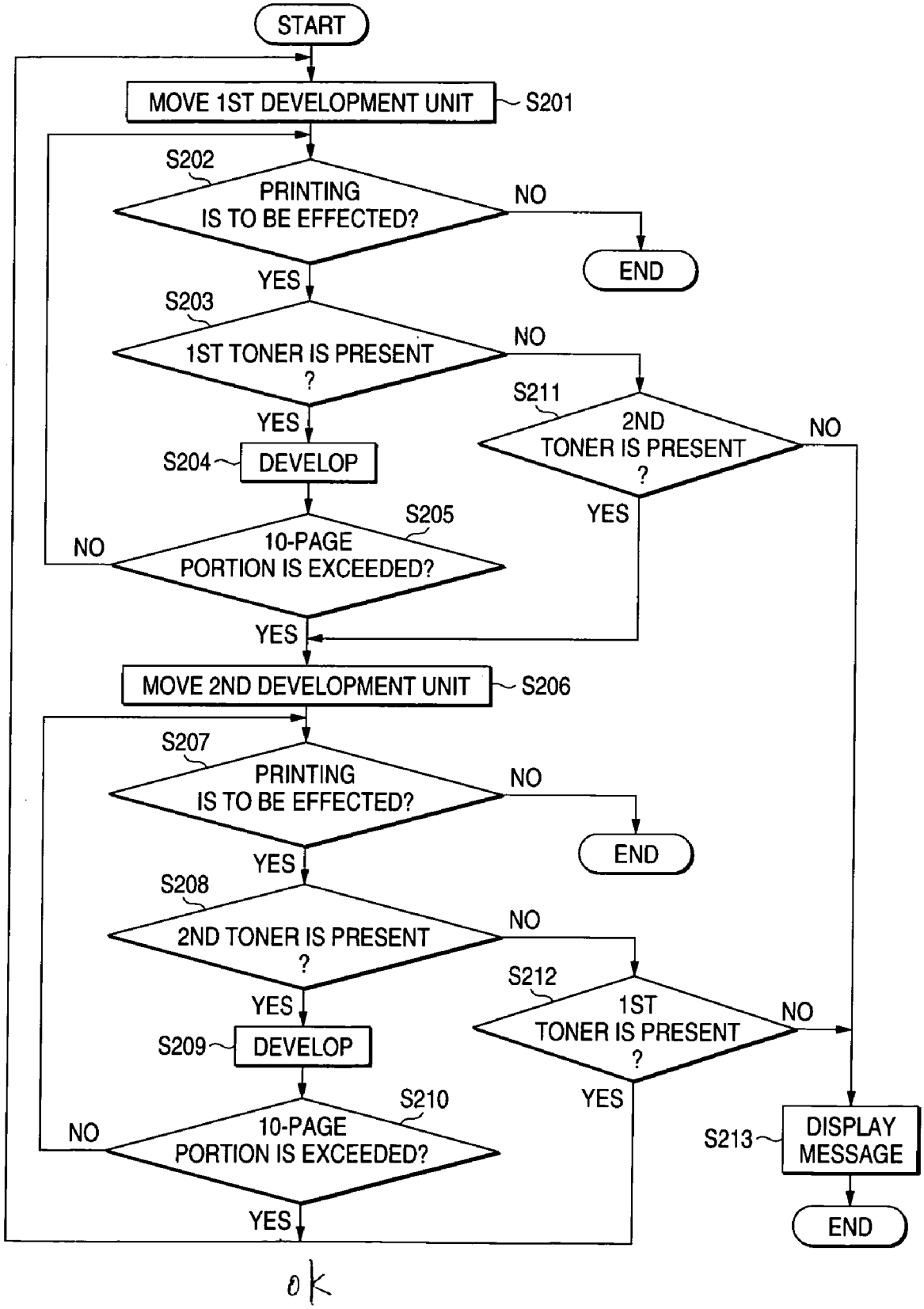
FIG. 5 is a flowchart illustrating a development operation in accordance with a second embodiment.

Further, in the second embodiment, referring to the flowchart shown in FIG. 5, a description will be given of the operation in which monochrome printing by the image forming apparatus 10 of the above-described configuration is effected by development using the two units of the first and second development units 231 and 232 installed at mutually opposing positions among the first to fourth development units 321 to 234. Namely, the first and second development units 231 and 232 installed at mutually opposing positions in the development rotary 22 are identified by the CPU 40, and the rotation of the development rotary 22 is controlled so that the two development units 231 and 232 will be respectively positioned at the development position. In addition, identification information to the effect that the black toner is accommodated is stored in the respective nonvolatile memories 23*e* of the first and second development units 231 and 232. Information on the presence of the two development units 231 and 232 and identification information on the development units 231 and 232 are stored in the main body memory 46.

After a print command signal (image information signal) from the host computer 36 is converted into black image data by the controller portion 38, and predetermined processing is effected, information requesting a development start is transmitted to the engine control portion 35. Then, an electrostatic latent image is formed by the charger 19 and the exposure unit 21.

Subsequently, the development rotary 22 is rotatively driven to move the first development unit 231 to the development position (Step S201 . Next, the presence or absence of printing is determined (S202). If it is determined that there is printing to be effected (YES in S202), the presence or absence of the toner in the first development unit 231 is determined (S203; incidentally, shown as "IS 1$^{st}$ TONER PRESENT?" in FIG. 5). On the other hand, if it is determined that there is no printing to be effected (NO in S202), print processing ends.

Then, if it is determined in S203 that the toner is present in the first development unit 231 (YES in S203), development is effected by using the toner in the first development unit 231 (S204). Subsequently, the amount of toner used in the first development unit 231 is determined based on the aforementioned criterion (S205). If it is determined that the amount of toner used in the first development unit 231 has not reached the continuous 10-page portion (NO in S205), the operation returns to S202 to determine the presence or absence of printing that remains to be effected (S202). If it is determined that there is no more printing to be effected (NO in S202), development processing, i.e., print processing, ends. If it is determined that there is more printing to be effected (YES in S202), processing similar to the one described above is carried out again.

If it is determined in S205 that the amount of toner used in the first development unit 231 has reached the continuous 10-page portion (YES in S205), the development rotary 22 is rotatively driven 180 degrees to move the second development unit 232 to the development position (S206) Next, the presence or absence of printing is determined (S207). If it is determined that printing is present (YES in S207), the presence or absence of the toner in the second development unit 232 is determined (S208; incidentally, shown as "IS 2$^{ND}$ TONER PRESENT?" in FIG. 5). On the other hand, if it is determined that printing is absent (NO in S207), print processing ends.

Then, if it is determined in S208 that the toner is present in the second development unit 232 (YES in S208), development is effected by using the toner in the second development unit 232 (S209). Subsequently, the amount of toner used in the second development unit 232 is determined based on the aforementioned criterion (S210). If it is determined that the amount of toner used in the second development unit 232 has not reached the continuous 10-page portion (NO in S210), the operation returns to S207 to determine the presence or absence of printing that remains (S207). If it is determined that there is no more printing to be effected (NO in S207), print processing ends. If it is determined that there is more printing to be effected (YES in S207), processing similar to the one described above is carried out again.

If it is determined in S210 that the amount of toner used in the second development unit 232 has reached the continuous 10-page portion (YES in S210), the development rotary 22 is rotatively driven 180 degrees to move the first development unit 231 to the development position (S201).

Then, processing starting from S201 is carried out again in the same way as described above, and development is effected while a changeover is being made between the first development unit 231 and the second development unit 232 until there is no more printing to be effected. If there is no more printing, development processing, i.e., print processing, ends.

It should be noted that if it is determined in S203 that the toner is absent in the first development unit 231 (NO in S203), the presence or absence of the toner in the second development unit 232 is determined (S211). Then, if it is determined that the toner is present in the second development unit 232 (YES in S211), the development rotary 22 is rotatively driven 180 degrees to effect development using the second development unit 232, so that the second development unit 232 is moved to the development position (S206). Then, processing starting from S206 is carried out in the same way as described above.

On the other hand, if it is determined in S211 that the toner is absent in the second development unit 232. (NO in S211), a message to the effect that the toner is absent in the first or second development unit 231 or 232 is displayed on the display portion (not shown) of the image forming apparatus 10 (213), and print processing subsequently ends.

Furthermore, if it is determined in S208 that the toner is absent in the second development unit 232 (NO in S208), the presence or absence of the toner in the first development unit 231 is determined (S212). Then, if it is determined that the toner is present in the first development unit 231 (YES in S212), the development rotary 22 is rotatively driven 180 degrees to effect development using the first development unit 231, so that the first development unit 231 is moved to the development position (S201). Then, processing starting from S201 is carried out in the same way as described above.

On the other hand, if it is determined in S212 that the toner is absent in the first development unit 231 (NO in S212) a message to the effect that the toner is absent in the first or second development unit 231 or 232 is displayed on the display portion (not shown) of the image forming apparatus 10 (S213), and print processing subsequently ends.

Accordingly, in the second embodiment, control is provided by the CPU 40 so as to identify the first development unit 231 and the second development unit 232 installed at mutually opposing positions in the development rotary 22 and position the respective development units 231 and 232 to the development position. For this reason, the first development unit 231 and the second development unit 232 are used by being changed over in correspondence with the amount of toner used, to permit large-quantity and continuous monochrome development, i.e., monochrome printing.

In addition, in the second embodiment as well, in addition to the advantages (1) and (2) of the first embodiment, the development rotary 22 used is rotated 180 degrees for each predetermined amount of development to change the development units 231 and 232, so that the used charged toner which is present on the supply roller 23*c* side and the unused toner inside the case 23*a* are uniformly mixed and refreshed by that rotation. Further, if the development rotary 22 is rotated 180 degrees again, the refreshed toner is supplied to the supply roller 23*c*, and development is effected by that refreshed toner. As a result, it is possible to prevent the development of an electrostatic latent image by the toner in which charged toner is scattered in a large quantity, thereby making it possible to prevent a decline in the image quality obtained.

It should be noted that this embodiment can be embodied by making the following modifications.

- In the first embodiment, the amount of toner consumed is stored in the nonvolatile memory 23*e*, and the development rotary 22 is rotated based on that amount of toner consumed. However, a toner counter may be provided, and the development rotary 22 may be rotated when the consumption of the toner by a predetermined amount has been counted by the toner counter.
- In the second embodiments the amount of toner used is converted to a number of printing pages, and the time when a predetermined number of pages has been reached is set as the timing for the changeover the development unit 23. However, the changeover timing may be changed to the total printing time, the number of times of development, the number of printing dots, the period of the vertical synchronizing signal (VSYNC), or the like.
- In the second embodiment, the amount of used toner in the development units 231 and 232 is converted to a quantity necessary or development, i.e., printing, on the recording medium 32 of the A4 size, and whether or not a continuous 10-page portion has been reached is set as the changeover timing. However, the paper size of the recording medium 32 may be changed to A3, A5, B4, B5, or a post card, and the converted quantity may be changed, as required, to continuous 20 pages, 30 pages, 40 pages, or the like.
- In each embodiment, the development rotary 22 may be arranged so as to be capable of installing five or more development units 23, development units 23 accommodating the toners of yellow, cyan, and magenta may be installed, and two or more development units 23 accommodating the black toner may be installed. If such an arrangement is provided, development by the black toner and full-color development become possible.
- In the first embodiment, any one of the following may be carried out: monochrome development using any one of the first to fourth development units 231 to 234; monochrome development using the first and second development units 231 and 232; monochrome development using the first to third development units 231 to 233; monochrome development using the second and third development units 232 and 233; monochrome development using the first to fourth development units 231 and 234; monochrome development using the second to fourth development units 232 to 234; and monochrome development using the third and fourth development units 233 and 234.
- In the second embodiment, the development units 231 and 232 of black may be installed at mutually opposing positions in the development rotary 22, and the development units 233 and 234 of a different and the same color may be installed at the other mutually opposing positions. If such an arrangement is provided, the image forming apparatus 10 is capable of two-color printing including monochrome development by the black toner and monochrome development by the toner of the other color.
- In the second embodiment, development may be effected by using only the first or the second development unit 231 or 232.
- In each embodiment, the development rotary 22 is made rotatively drivable in one direction, but the development rotary 22 may be arranged to be rotatively drivable in both forward and reverse directions. For example, at least two development units 23 of the same color may be installed at adjacent positions, and the development units 231 and 232 which are used based on a predetermined criterion may be changed over between the two development units 231 and 232.

In each embodiment, monochrome printing is effected by development using the black toner, the development units 23 accommodating the toner of yellow, cyan, or magenta may be installed in the development rotary 22 to effect monochrome printing in yellow, cyan, or magenta.

In the first embodiment, the four development units 231 to 234 are installed in the development rotary 22. However, two development units 231 and 232 or three development units 231, 232, and 233 may be installed, and development may be effected by using them by turns. It should be noted that, at this time, a development unit 23 in which the toner is not accommodated may be installed in the development rotary 22. Furthermore, at least two development units 23 accommodating the toner of the same color may be installed in the development rotary 22 capable of installing five or more development units 23, so as to effect monochrome development.

In the first embodiment, an agitating member for agitating the toner inside the case 23*a* may be provided. If such an arrangement is provided, since the toner in the case 23*a* is refreshed by the agitating member, it is possible to prevent the development of an electrostatic latent image by the toner in which charged toner is scattered in a large quantity, thereby making it possible to prevent a decline in the image quality obtained.

In each embodiment, the first to fourth units 231 to 234 having the same shape are used, but it is possible to use the first to fourth units 231 to 234 having different shapes.

In each embodiment, the development units 231 to 234 of the same color in the development rotary 22 are identified based on the color information and position information stored in the nonvolatile memories 23*e* as the storage means of the first to fourth development units 231 to 234. However, the nonvolatile memories 23*e* of the development units 231 to 234 may be omitted. Then, color information making it possible to identify the development units 231 to 234 for each color, such as angles of reflection of projections and reflecting mirrors, may be formed on the first to fourth development units 231 to 234, that color information may be identified by the CPU 40, and the color information may be stored in the main body memory 46 by being related to the position information in the development rotary 22. Then, the CPU 40 may identify the development units 23 of the same color based on the information stored in the main body memory 46 to control the rotation of the development rotary 22, thereby effecting monochrome development.

In each embodiment, identification information including color information is stored in the nonvolatile memories 23*e* of the first to fourth development units 231 to 234, but the identification information may be stored in the main body memory 46. Then, monochrome development may be effected by identifying the development units 23 of the same color by relating the identification information and the position information stored in the main body memory 46.

In each embodiment, the development units 231 to 234 are identified based on the color information stored in the nonvolatile memories 23*e,* but the development units 231 to 234 may be identified based on various information including toner-remaining-amount information, toner quality information, and the date of manufacture of the toner, and the like.

An arrangement may be provided such that the photosensitive body 17 is disposed at a position below the development rotary 22, and development is effected by the development units 23 positioned immediately below the development rotary 22. If such an arrangement is provided, in the case where the development rotary 22 is arranged to be rotatively drivable in both forward and reverse directions and the development units 23 are installed at, for instance, adjacent positions, and the development unit 23 used is changed over between the two development units 23, the agitation and mixing of the toner is carried out effectively, and the toner is refreshed.

In each embodiment, development by the toner is effected by installing the development units 231 to 234 in the development rotary 22 with respect to one photosensitive body 17, the invention maybe embodied as a tandem-type image forming apparatus 10 in which an image forming unit is formed by providing a development unit 23 of one color with respect to one photosensitive body 17, and four image forming units are provided, or as an elevator-type image forming apparatus 10 having image forming units in which the first to fourth development units 231 to 234 are raised or lowered with respect to one photosensitive body 17 to effect development by the respective development units 231 to 234. Furthermore, in the image forming apparatus 10 of each type, at least two development units 23 accommodating the toner of the same color may be provided to effect monochrome development by development using the at least two development units 23.

In the first embodiment, when the toner in the development unit 23 being used has been exhausted, development may be effected by using the development unit 23 at a mutually opposing position by rotating the development rotary 22 180 degrees. If such an arrangement is adopted, when the development unit 23 is changed over, the agitation and mixing of the toner is carried out effectively, and the toner is refreshed.

In each embodiment, development is effected by causing the development roller 23*b* to come into sliding contact with the pp 17, but development may be effected by a jumping system.

In each embodiment, the storage means is embodied as the ROM, but the storage means may be embodied as a bar code, a magnetic tape, or the like.

In the first embodiments, the image forming apparatus 10 is embodied as a color printer, but the image forming apparatus 10 may be embodied as a monochromatic color printer, a facsimile machine, or the like.

Next, technical concepts which can be ascertained from the foregoing embodiments and modifications will be additionally described together with their advantages.

An image forming apparatus characterized in that development units are installed at mutually opposing positions in the development unit holder, and the development unit holder is arranged to be rotatively drivable to allow the development units to be inverted by a control unit. If such an arrangement is provided, when the development unit is changed over, the agitation and mixing of the toner is carried out effectively, and the toner is refreshed.

Since the present invention is arranged as described above, the following advantages are offered.

According to the image forming apparatus of the invention, it is possible to effect development by a monochromatic toner in a large quantity without changing the design of the development units and the development unit holder and, during the development, make it possible to reduce the number of times of replacement of the development unit by delaying the time when the toner is used up.

According to the image forming apparatus of the invention, in addition to the above-described advantages, identification of the development units can be effected easily.

According to the image forming apparatus of the invention, in addition to the above-described advantages, the used charged toner and the unused toner can be agitated and mixed to refresh the entire toner. Hence, it is possible to prevent the development of an electrostatic latent image by the toner in which charged toner is scattered in a large quantity, thereby making it possible to prevent a decline in the image quality obtained.

According to the image forming apparatus of the invention, in addition to the above-described advantages, a time lag can be eliminated which can occur when the development unit is changed over after it became known that the toner in the development unit has been completely used up, and that development has become impossible. Accordingly, it is possible to effect continuous development by a monochromatic toner.

Since the present invention is arranged as described above, the following advantages are offered.

According to the image forming apparatus of the invention, it is possible to effect development by a monochromatic toner in a large quantity without changing the design of the development units and the development unit holder and, during the development, make it possible to reduce the number of times of replacement of the development unit by delaying the time when the toner is used up.

What is claimed is:

1. An image forming apparatus comprising:

an electrostatic latent image carrier for carrying an electrostatic latent image on a peripheral surface thereof;

a plurality of development units each accommodating a toner and adapted to develop the electrostatic latent image by the toner;

a development unit holder capable of holding said plurality of development units; and a control unit for said development unit holder for controlling an operation of said development unit holder and for selectively changing over said plurality of development units to be used in a development, wherein when an amount of toner consumed in a first development unit of said development units that is in use in the development has reached a predetermined amount, said development unit holder is rotated 360 degrees for agitating the toner in said first development unit to continue the development using said first development unit.

2. The image forming apparatus according to claim 1, wherein said first development unit includes a first side in which a supply roller is accommodated and a second side that is partitioned with a partition wall from said first side.

3. The image forming apparatus according to claim 1, wherein said development unit holder is a rotary body which selectively changes over said development units as said rotary body is rotatively driven, and said rotary body moves any one of said development units to a position opposing said electrostatic latent image carrier as said development unit holder is rotatively driven by said control unit.

4. The image forming apparatus according to claim 1, wherein said first development unit has a memory for storing the amount of toner consumed.

5. The image forming apparatus according to claim 1, wherein the amount of toner consumed in said first development unit is read after said development unit holder is rotated 360 degrees for agitating the toner in said first development unit, and the development is continued using said first development in a case that the toner in said first development unit is still present.

6. The image forming apparatus according to claim 1, wherein said image formation apparatus is provided with an identifying device for identifying at least color information on the toner accommodated in said first development unit, said development unit holder is capable of holding at least two development units accommodating the toner of a same color, and said control unit identifies said development units of the same color based on the color information identified by said identifying device, and controls the operation of said development unit holder so as to effect monochrome development by using said at least two development units.

7. A method of forming an image by an image forming apparatus in which color information on a toner accommodated in a plurality of development units held in a development unit holder is identified by an identifying device, and a development unit used in development is selectively changed over among said plurality of development units by a control unit for controlling said development unit holder, so as to effect a development, comprising the steps of:

selecting one of said development units that is used in the development;

rotating said development unit holder 360 degrees for agitating the toner in said selected development unit, when an amount of toner consumed in said selected development unit has reached a predetermined amount; and continuing the development using said selected development unit.

8. The method of forming an image according to claim 7, wherein said selected development unit includes a first side in which a supply roller is accommodated and a second side that is partitioned with a partition wall from said first side, and said predetermined amount is an amount at which the toner can be accommodated on the first side in said development unit.

9. The method of forming an image according to claim 7, wherein the amount of toner consumed in said first development unit is read after said development unit holder is rotated 360 degrees for agitating the toner in said first development unit, and the development is continued using said first development unit in a case that the toner in said first development unit is still present.

10. The method of forming an image according to claim 7, further comprising the steps of:

identifying the color information on the toner accommodated in said development unit by said identifying device; and identifying said development units of a same color based on the color information, and controlling the operation of said development unit holder by said control unit so as to effect monochrome development by using at least two of said development units accommodating the toner of the same color.

11. An image forming apparatus comprising:

an electrostatic latent image carrier for carrying an electrostatic latent image on a peripheral surface thereof;

a plurality of development units each accommodating a toner and adapted to develop the electrostatic latent image by the toner;

a development unit holder capable of holding said plurality of development units; and a control unit including a controller portion for processing image information and an engine control portion that identifies at least color information on toner accommodated in each development unit and controls said development unit holder, wherein, in a case that said engine control potion identifies that a monochromatic toner is accommodated in each development unit, an image information sent from an external device is converted into monochromatic image data by the controller portion, and the monochromatic image data is stored in the controller portion, and a monochromatic development is performed based on the monochrome image data provided by the controller portion.

12. The image forming apparatus according to claim 11, wherein each development unit has a memory for storing the color information, and the color information is identified by said engine control portion.

13. The image forming apparatus according to claim 11, wherein RGB data is sent from the external device as the image information.

14. A method of forming an image by an image forming apparatus in which color information on a toner accommodated in a plurality of development units held in a development unit holder is identified by an engine control portion, and an image information sent from an external device is processed and stored by a controller portion, a development unit used in development is selected among said plurality of development units by said engine control portion by controlling said development unit holder, comprising the steps of:

identifying the color information on the toner accommodated in each development unit by said engine control portion; and providing an image data for development by the controller portion; and performing a development using one of said development units;

wherein, in a case that said engine control potion identifies that a monochromatic toner is accommodated in each development unit, an image information sent from an external device is converted into monochromatic image data by the controller portion, and the monochromatic image data is stored in the controller portion, and a monochromatic development is performed based on the monochrome image data provided by the controller portion.

15. The method of forming an image according to claim 14, wherein each development unit has a memory for storing the color information, and the color information is identified by said engine control portion.

16. The method of forming an image according to claim 14, wherein RGB data is sent from the external device as the image information.

* * * * *